United States Patent [19]

Takahashi et al.

[11] 4,250,207

[45] Feb. 10, 1981

[54] METHOD FOR APPLYING COATING OF MOLTEN METALS

[75] Inventors: Hisashi Takahashi; Satoshi Hanai; Katsuyoshi Yoshida, all of Toukai, Japan

[73] Assignee: Nippon Steel Corporation, Tokyo, Japan

[21] Appl. No.: 43,096

[22] Filed: May 29, 1979

[30] Foreign Application Priority Data

May 29, 1978 [JP] Japan ..... 53-63317

[51] Int. Cl.[3] ..... C23C 1/02; C23C 1/08; C23C 1/16

[52] U.S. Cl. ..... 427/211; 427/320; 427/321; 427/377; 427/428; 118/223; 118/224; 118/227

[58] Field of Search ..... 427/211, 428, 310, 313, 427/328, 329; 118/253, 247, 227, 243, 224, 223, 262, 228, 238, 225; 266/115, 134

[56] References Cited

U.S. PATENT DOCUMENTS

| | | | |
|---|---|---|---|
| 2,937,108 | 5/1960 | Toye | 427/211 |
| 3,228,788 | 1/1966 | Teplitz | 427/428 |
| 3,606,861 | 6/1969 | Schaeuble | 118/224 |
| 4,103,644 | 8/1978 | Michels | 118/223 |

FOREIGN PATENT DOCUMENTS

| | | | |
|---|---|---|---|
| 356738 | 7/1922 | Fed. Rep. of Germany | 427/428 |
| 786,432 | 6/1935 | France | 427/428 |

OTHER PUBLICATIONS

Lowenheim, Modern Electroplating, Third Ed. 1974, John Wiley & Sons, pp. 1, 2.

*Primary Examiner*—Ralph S. Kendall
*Attorney, Agent, or Firm*—Wenderoth, Lind & Ponack

[57] ABSTRACT

A plating chamber holds a reducing or inert atmosphere heated to a temperature suited for plating or galvanizing. A pair of power-driven coating rolls are horizontally disposed in the plating chamber, one roll contacting the top surface of a metal strip to be plated and the other contacting the bottom surface. A molten coating metal is continuously supplied so as to form a uniform film of the metal on the peripheral surface of each coating roll. By means of deflector rolls horizontally disposed in the plating chamber, a metal strip heated to a temperature suited for plating continuously travels through the chamber. A surface of the strip becomes plated on contacting the peripheral surface of the coating roll on which the film of the molten coating metal has been formed. The coating rolls can be drawn away from the surface of the strip by shifting the deflector or coating rolls, so that plating can be applied to one, both or neither side of the strip as desired.

6 Claims, 13 Drawing Figures

METHOD FOR APPLYING COATING OF MOLTEN METALS

BACKGROUND OF THE INVENTION

This invention relates to a method and apparatus for applying a coating of molten metal, and more particularly it relates to a method and apparatus for providing a metallic coating on the surface of a steel strip with coating rolls.

A widely known strip plating method comprises continuously supplying a molten coating metal so that a uniform film of the metal is formed on the peripheral surface of a coating roll and bringing a steel strip, continuously traveling in its longitudinal direction in contact with the coating roll.

Steel strips with such metallic coatings as zinc and tin are used for various applications. Some uses call for plating on one side only, and others demand plating of different metals on both sides. Some orders specify that neither side be plated.

None of the conventional metallic coating apparatus has permitted a choice from among such one-side, two-side and no-plating operations on a single unit. For example, U.S. Pat. No. 2,937,108 discloses a method of plating both sides of a strip, and U.S. Pat. No. 3,228,788 discloses a one-side strip plating method. Neither of them permits switching from one-side plating to two-side plating or vice versa, or plating different metals on opposite sides. Provision of separate units for one-side and two-side plating is uneconomical in terms of both capital investment and running cost.

SUMMARY OF THE INVENTION

An object of this invention is to provide a method and apparatus for plating one side or both sides, as desired, of a metal strip with a molten metal in a single plating unit.

Another object of this invention is to provide a method and apparatus for continuously plating both sides of a metal strip with different molten metals.

This invention adds a feature to the conventional molten metal plating method comprising the steps of continuously supplying molten coating metal so that a uniform film of the coating metal in formed on the peripheral surface of each of a pair of power-driven coating rolls horizontally disposed so as to individually contact the top and bottom surfaces of a metal strip in a plating chamber that holds a reducing or inert atmosphere heated to a temperature suited for the plating, continuously feeding the metal strip heated to a temperature suitable for plating over deflector rolls horizontally disposed in the plating chamber, and bringing the strip in contact with the peripheral surface of the coating rolls on which the film of coating metal has been formed. This feature, for achieving the aforementioned objects, comprises drawing away the coating rolls from the surface of the strip by shifting the deflector or coating rolls. By this means, this invention permits applying metallic coating on one, both or neither side of the strip as desired. In a plating method that supplies molten coating metal from pick-up rolls to coating rolls, the same objects can be achieved by withdrawing the pickup rolls from the coating rolls.

To implement the above-described plating method, the plating apparatus according to this invention comprises coating or deflector rolls that are disposed so as to be movable away from the strip surface.

Both sides of a metal strip can be continuously plated with different coating metals by supplying such molten metals to the respective rolls of a pair of coating rolls.

BRIEF DESCRIPTION OF THE DRAWINGS

FIG. 6 shows an embodiment in which one coating roll is shifted by a hydraulic cylinder.

FIG. 7 shows an embodiment in which two coating rolls, symmetrically disposed on both sides of a strip, are shifted by respective hydraulic cylinders.

FIG. 8 shows an embodiment that has three deflector rolls in a plating chamber, with one coating roll shifted by a hydraulic cylinder.

FIG. 9 shows an embodiment in which a strip is plated in the horizontal position, with coating metal pumped to one coating roll.

FIG. 10 shows an embodiment in which a strip is displaced by shifting one deflector roll by a hydraulic cylinder.

FIG. 11 shows an embodiment in which a strip is displaced by horizontally shifting two deflector rolls by respective hydraulic cylinders.

FIG. 12 shows an embodiment in which one, both or neither side of a strip is brought in contact with coating rolls by selectively shifting two deflector rolls horizontally.

FIG. 13 shows an embodiment that has two plating chambers.

DETAILED DESCRIPTION OF THE PREFERRED EMBODIMENTS

Figure 1:
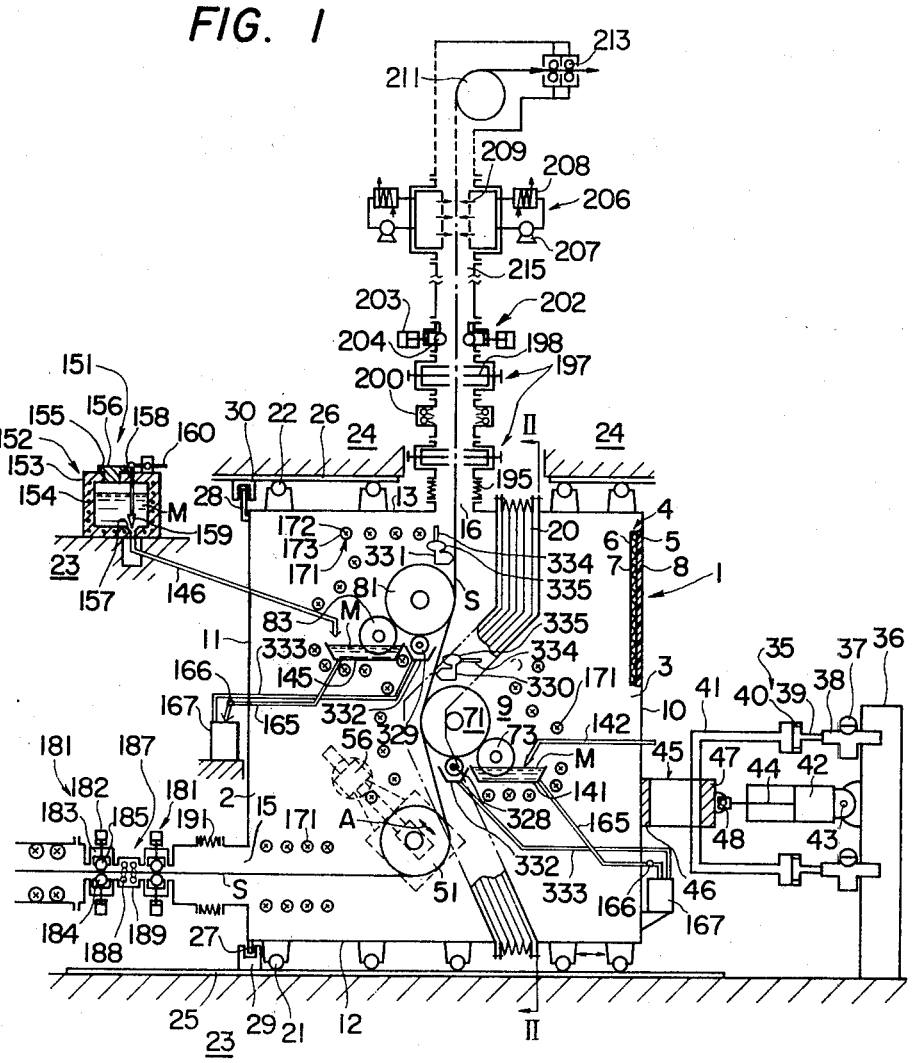
FIG. 1 is a schematic overall cross-sectional view of an embodiment of the plating apparatus according to this invention.
Figure 2:
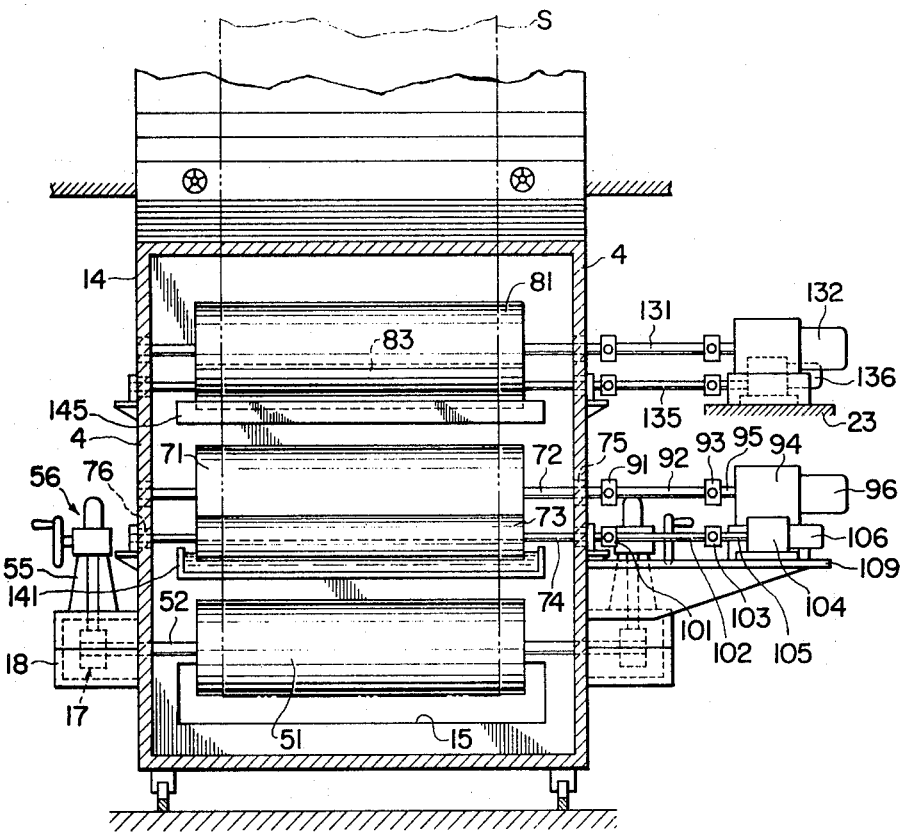
FIG. 2 is a cross section taken along the line II—II of FIG. 1.

FIGS. 1 and 2 are schematic overall views of an embodiment of apparatus that carries out the electroplating method of this invention. This invention will be described in connection with an operation of galvanizing a 0.8 mm thick, 1,200 mm wide steel strip.

A plating chamber 1, as a whole, is substantially cubic, and comprises a fixed front section 2 and a movable rear section (at the left and right in FIG. 1). Walls 4 of the plating chamber 1 are comprised of an outside plate 5 and an inside plate 6, with a nichrome wire heater 7 interposed therebetween. The inside of the outside plate 5 is lined with heat-insulating ceramic 8. Wheels 21 and 22 are fitted to the bottom 12 and top 13 of the plating chamber 1. By means of these wheels 21 and 22, the plating chamber 1 is guided along rails 25 and 26 longitudinally positioned on the floor 23 and ceiling 24 of the building in which the chamber 1 is located. Metal projections 27 and 28 are provided at the front end of the bottom 12 and top 13, respectively, of the fixed section 2. Normally, the projections 27 and 28 are engaged with metal receivers 29 and 30 fixed to the floor 23 and ceiling 24 respectively, whereby the fixed section 2 of the plating chamber 1 is held stationary.

The center of the back of the fixed section 2 has a forwardly extending indentation, and the center of the front of the movable section 3 has a forwardly extending projection 9 which fits into the indentation. The fixed and movable sections 2 and 3 are shaped as described above and a coating roll 71 and a pickup roll 73, described later, are supported on the projection 9 of the movable section 3. The rear end of the fixed section 2 and the front end of the movable section 3 are connected by a longitudinally flexible bellows 20 so that the plating chamber 1 is kept airtight. The bellows 20 is, for example, made of asbestos cloth. In this embodiment, when the movable section 3 is moved back and forth with respect to the fixed section 2 this produces expansion and contraction of the bellows 20. The maximum stroke, which depends on the diameter of the coating roll and the length of the arc of contact between the strip and the coating roll, is usually designed to fall within the range of approximately 300 to 1,500 mm.

Next, a device 35 for positioning the movable section 3 will be described. As shown in FIG. 1, a vertical stand 36 is provided spaced rearwardly from the movable section 3 of the plating chamber 1. The stand 36 carries two screw jacks 38 spaced from each other, one above the other, with the rod 39 of each moved back and forth by a motor 37. A forwardly extending C-shaped frame 41 is attached to the front flanges 40 of rods 39 whereby they are connected to each other. The stand 36 carries a swingable hydraulic cylinder 42 mounted on a pin 43, intermediate the two screw jacks 38. An intermediate metal support 45 is fixed to the rear end surface 10 of the movable section 3 opposite to the hydraulic cylinder 42. The intermediate metal support 45 has an engaging end 47 that is spaced from the base end 46 thereof by a distance equivalent to the stroke of the movable section 3. The engaging end 47 engages with the C-shaped frame 41 and is connected to the free end of the rod 44 of the hydraulic cylinder 42 through a pin 48.

Using the above-described positioning device 35, the movable section 3 of the plating chamber 1 is positioned as follows: First, the motors 37 drive the screw jacks 38 to move the rods 39 back and forth for placing the C-shaped frame 41 in a position that corresponds to the position in which the movable section 3 is to be fixed. Next, the hydraulic cylinder 42 is driven to move the movable section 3 forward (to the left in FIG. 1) through the intermediate metal support 45, until the engaging end 47 contacts the C-shaped frame 41. When the engaging end 47 contacts the C-shaped frame 41, the movable section 3 is in position. In case of emergency, the hydraulic cylinder 42 quickly withdraws the movable section 3 to the point where the base end 46 of the intermediate metal support 45 contacts the C-shaped frame 41.

A deflector roll 51 is horizontally and rotatably provided in the fixed section 2 of the plating chamber 1. A rectangular inlet 15 is provided close to the bottom of the front wall 11 of the plating chamber 1, and a rectangular outlet 16 is provided approximately in the middle of the top 13. A horizontal line passing through the center of the inlet 15 and a vertical line passing through the center of the outlet 16 constitute the pass line of a strip S, with the deflector roll 51 normally being positioned where the two lines intersect.

Figure 3:
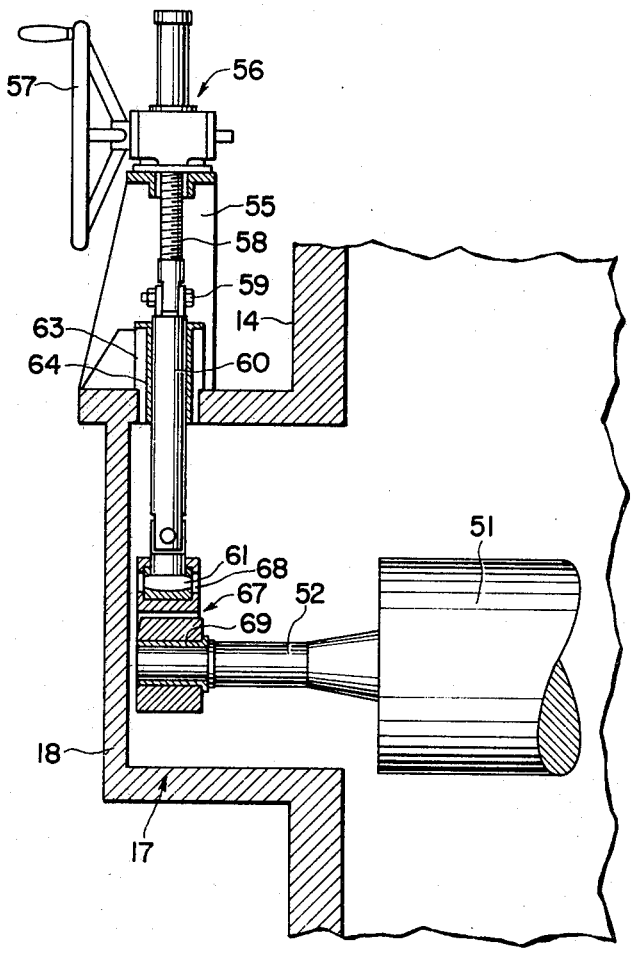
FIG. 3 is a detailed cross-section, on an enlarged scale, of a device for raising and lowering deflector rolls provided in the apparatus of FIG. 1.

As shown in FIG. 2, a small square chamber 17 projects from either side 14 of the fixed section 2 of the plating chamber 1, with the roll shaft 52 of the deflector roll 51 extending into the small chamber 17. A stand 55 is mounted on the external surface of the wall 18 of the small chamber 17, and a screwdown mechanism 56 including a threaded sleeve (not shown) is mounted on top of the stand 55. A threaded rod 58, shown in FIG. 3, engaged with the threaded sleeve of the screwdown mechanism 56, projects downward, and the lower end thereof is coupled to the upper end of an up-and-down shaft 60 through a pin 59. The up-and-down shaft 60 passes through a stuffing box 63 fitted in the wall 18 of the small chamber 17, with one end thereof extending inside the small chamber 17. The stuffing box 63, through which the up-and-down shaft 60 passes, is in airtight engagment with packing 64. The lower end of the up-and-down shaft 60 has a lens-shaped coupler 61 that engages with a notch 68 in a roll support member 67, whereby the up-and-down shaft 60 is coupled to the roll support member 67. The roll support member 67 carries a bearing 69 that rotatably contains the extreme end of the roll shaft 52 to support the deflector roll 51. By turning a wheel 57 of the screwdown mechanism 56, the up-and-down shaft 60 moves up and down, whereby the deflector roll 51 moves in a direction A at an angle of approximately 45 degrees with respect to the horizontal plane (see FIG. 1).

Along the vertical pass line inside the plating chamber 1 and above the deflector roll 51 is a horizontally disposed first coating roll 71 and a second coating roll 81. The two coating rolls 71 and 81 are held in contact with pickup rolls 73 and 83, respectively.

To transfer a film of molten zinc taken up by the peripheral surface of the pickup roll uniformly across the entire width of the peripheral surface of the coating roll, the pickup rolls 73 and 83 and the coating rolls 71 and 81 should be virtually held in contact with each other or separated from each other only by a distance equal to the thickness of the zinc film. During plating, therefore, the roll clearance is held between approximately 0 and 3 mm. Even when the roll clearance is virtually 0, the molten zinc can transfer onto the coating roll through minute surface irregularities in both rolls.

If needed, doctor rolls 328 and 329 may be provided so as to contact the peripheral surface of the coating rolls 71 and 81, respectively, beyond the point where said coating rolls contact the pickup rolls 73 and 83 and ahead of the point where said coating rolls contact the strip S, both directions being with respect to the direction of rotation. Gas wiping nozzles 330 and 331 also may be provided close to the opposite sides of the plated strip S that has just left the coating rolls 71 and 81. Each nozzle leads to a header 335 and a pipe 334 through which a reducing or inert gas is supplied.

As shown in FIG. 2, one end of a roll shaft 72 of the first coating roll 71 is rotatably supported by a bearing 75 fixed in the wall 4 of the movable section 3 of the plating chamber 1, while the other end projects slightly beyond the wall 4 through the bearing 75. The projecting end of the roll shaft 72 is connected to an output shaft 95 of a reduction gear 94 through a universal coupling 91, an intermediate spindle 92 and a universal coupling 93. The first coating roll 71 is power-driven by a variable-speed motor 96 the output of which is conveyed thereto through the above-described transmission mechanism.

Each end of a roll shaft 74 of the pickup roll 73 contacting the first coating roll 71 projects beyond the wall 4 of the movable section 3 of the plating chamber 1, and is supported by a movable bearing 76 to be described later. One end of the roll shaft 74 projecting beyond the movable bearing 76 is connected to an output shaft 105 of a reduction gear 104 through a universal coupling 101, an intermediate spindle 102 and a universal coupling 103. The pickup roll 73 is thus power-driven by a variable-speed motor 106 the output of which is conveyed thereto through the above-described transmission mechanism.

The reduction gears 94 and 104 are fixed on a bracket 109 fastened to one side 14 of the movable section 3. Accordingly, the first coating roll 71, pickup roll 73 and the drive units therefor as described above move integrally with the movable section 3 of the plating chamber 1.

Figure 4:
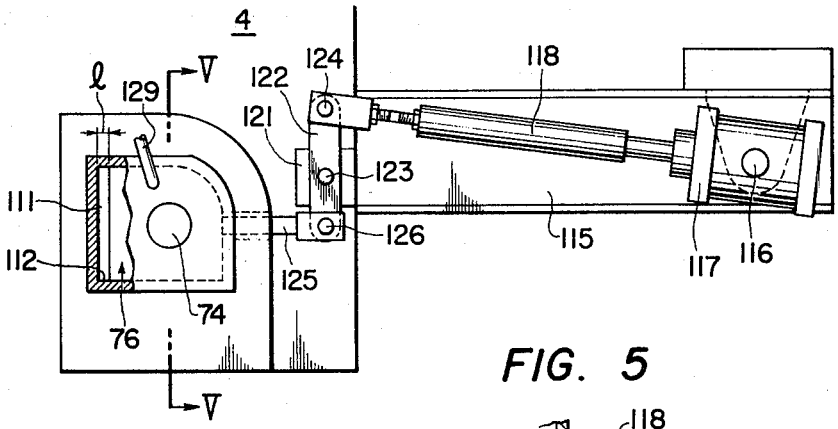
FIG. 4 is a side view, partly in section, device for shifting the bearing provided in the apparatus of FIG. 1.
Figure 5:
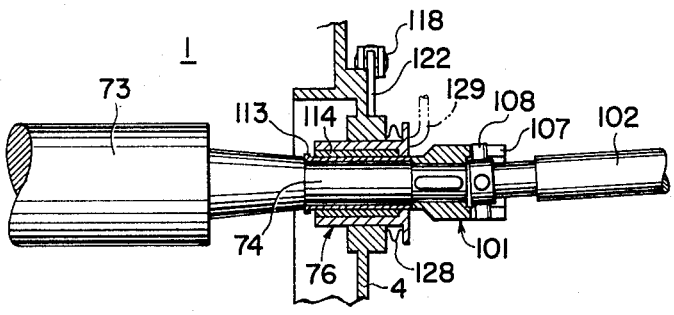
FIG. 5 is a cross section taken along the line V—V of FIG. 4.

FIGS. 4 and 5 show details of the movable bearing 76 that supports the pickup roll 73. As seen, a substantially rectangular opening 111 is provided in the wall 4 of the movable section 3 of the plating chamber 1, with the lower side thereof forming a sliding surface 112. The movable bearing 76 is inserted in the opening 111 so as to be slidable back and forth (from left to right and reversely in FIG. 4) along the sliding surface 112. The roll shaft 74 of the pickup roll 73 passes through the movable bearing 76, with a sleeve 113 being tightly-fitted on the bearing engaging portion. The roll shaft 74 is rotatably supported by the movable bearing 76, with the sleeve 113 contacting bearing metal 114.

An air or hydraulic cylinder 117 is swingably fitted on a pin 116 on a bracket 115 fixed to the wall 4. The bracket 115 carriers a support base 121 on which an arm 122 is mounted so as to be rotatable about a pin 123. One end of the arm 122 is connected through a pin 124 to one end of the rod of said cylinder 117, and the other end through a pin 126 to a connecting rod 125 fastened to the movable bearing 76. The cylinder 117 thus reciprocates the movable bearing 76, which in turn shifts the pickup roll 73 supported thereby . The pickup roll 73 is shifted to adjust the gap between it and the first coating roll 71 and the force imposed on the latter. Therefore, the amount of the shift or the reciprocating stroke 1 of the movable bearing 76 falls within a limited range of approximately ±5 mm. The negative stroke is used when making up for a roll wear.

The edges of the opening 111 in the wall 4 and the movable bearing 76 are connected by a bellows 128 so as to shut off the inflow and outflow of gases through the opening 111. Cold nitrogen gas is introduced from a pipe 129 to the inside of the bellows 128, as a shut-off gas.

FIG. 5 shows how the roll shaft 74, supported by the bearing, is connected to the intermediate spindle 102 through the universal coupling 101, by engaging a cross pin 108 with a notch 107. The same coupling method is applicable to the bearing and coupling means for the first coating roll 71, except that the bearing is movable and, therefore, the bellows is needed.

The second coating roll 81 and adjacent pickup roll 83 are supported in the fixed section 2 of the plating chamber 1 in the same manner as the first coating roll 71 and pickup roll 73. The second coating roll 81 and pickup roll 83 are power-driven by variable-speed motors 132 and 136 through transmission mechanisms 131 and 135, respectively, mounted on the support 23.

The bearing, driving and sealing mechanisms for the doctor rolls 328 and 329 (not shown) are similar to those for the pickup rolls 73 and 83.

The lower portions of the pickup rolls 73 and 83 are immersed in a bath of molten zinc 141 provided in the movable section 3 of the plating chamber 1 and a bath of molten zinc 145 in the fixed section 2.

Molten zinc is supplied to the zinc bath 141 and 145 from a molten zinc supply device 151 installed outside the plating chamber 1, through supply pipes 142 and 146. As shown in FIG. 1, the molten zinc supply device 151 comprises a heating oven 152 resting on the support 23. Oven walls 153 contain heating nichrome wires 154, to which electricity is supplied from a power supply (not shown) to keep the inside temperature above the melting point of zinc or, for example, between 440° and 490° C. Lump zinc is fed through a charging port 155 (usually covered with a lid 156) into the heating oven 152. Molten zinc M flows out through a port 157 in the bottom, through the supply pipe 146, into the bath 145. The flow rate of the molten zinc M is controlled by changing the area of an opening closed by a plug 159 at the lower end of the rod 158, which passes through the top wall 153, and the port 157, by raising and lowering the rod 158 by means of a lever 160.

The molten zinc supply device 151 supplies molten zinc to the upper zinc bath 145. A similar device (not shown) for supplying molten zinc to the lower zinc bath 141 is supported by a bracket (not shown) fastened to the outside wall of the movable section 3 of the plating chamber 1.

The bottoms of the zinc baths 141 and 145 each are connected to a discharge pipe 165 extending outside the plating chamber 1, with the remote end thereof leading to a recovery tank 167 through a stopcock 166. When the plating apparatus is shut down or coating metal is changed, the stopcock 166 is opened to send the molten zinc M from the baths 141 and 145 through the discharge pipes 165 to the recovery tanks 167. Usually, the discharge pipes 165, stopcocks 166 and recovery tanks 167 are kept at a temperature about the melting point of zinc.

When the doctor rolls are provided, molten zinc removed thereby is collected in receiving plates 332, then led to the recovery tanks 167 through discharge pipes 333.

As described previously, the whole inside of the plating chamber 1 is heated by the heater 7 provided in the walls 4. In addition, heaters 171 provide localized heating in the vicinity of the pass line of the strip S, coating rolls 71 and 81, and zinc baths 141 and 145. The heaters 171 each comprising a nichrome wire 172 and an enclosing bushing 173, and are disposed horizontally and extend across the plating chamber 1.

The entry side of the above-described plating chamber 1 is connected to a pre-treatment furnace (not shown) in which the strip S is cleaned and annealed. Between the pretreatment furnace and the plating chamber 1 are provided two sets of seal roll units 181, an atmosphere shut-off gas blowing box 187, and a bellows 191. The seal roll units 181 and atmosphere shut-off gas blowing box 187 hold down to a tolerable level the mixture of gases leaking into both the plating chamber 1, which contains a reducing or inert atmosphere, and the pre-treatment furnace.

The seal roll unit 181 comprises a pair of frames 183 disposed above and below the steel strip S and reciprocated by air or hydraulic cylinders 182. The frames 183 rotatably support a bottom seal roll 184 that is always kept in contact with the lower side of the strip S and a top seal roll 185 that is kept 3 to 5 mm away from the upper side of the strip S. The seal rolls 184 and 185 are power-driven by a driving device (not shown) so that their peripheral speed is equal to the travel speed of the strip S. In case of emergency, the air or hydraulic cylinders 182 actuate the top and bottom seal rolls 184 and 185 to catch the strip S from both sides, thereby shutting off the passage between the pre-treatment furnace and the plating chamber 1.

The shut-off gas blowing box 187 comprises a nozzle 188 that constantly blows shut-off nitrogen gas into a box 189.

The bellows 191 absorbs the thermal expansion and contraction of the plating chamber 1, pretreatment furnace and other devices interposed therebetween.

On the exit side of the plating chamber 1 are provided a bellows 195, yoke-type seals 197 preceding and following a shut-off gas blowing box 200, an emergency shut-off device 202, a cooling device 206, a deflector roll 211, and a seal roll device 213 in that order. The bellows 195, shut-off gas blowing box 200 and seal roll device 213 have the same construction as those on the entry side. The deflector roll 211 functions only to change the running direction of the strip S from vertical to horizontal.

The yoke-type seal 197 has a yoke that extends close to the surface of the strip S, and prevents the outflow of the gas from the plating chamber 1 by a labyrinth effect. The emergency shut-off device 202 comprises hydraulic 203 that actuate, in emergency, seal rolls 204 to catch the strip S from both sides, thus keeping the plating chamber 1 airtight. The cooling device 206 comprises a blower 207 that sucks the gas from a passage 215 on the entry and exit sides of the device. The sucked gas is cooled in a heat exchanger 208, then blown from nozzles 209 to cool both sides of the strip S.

A method of galvanizing a steel strip in the above-described plating apparatus will be described hereunder with reference to FIG. 1.

A steel strip S to be galvanized is continuously fed from pay-off reels (not shown) to the pre-treatment furnace (not shown) where the strip S is cleaned, annealed and cooled to a temperature, 420° to 550° C., suited for electroplating, then to the plating chamber 1.

The plating chamber 1 is filled with a reducing or inert gas consisting of 0 to 1 percent hydrogen and 100 to 99 percent nitrogen, and kept at a pressure of approximately 10 mmAq. The heaters 7 and 171 heat the inside of the plating chamber 1 to above the melting point of zinc, or between 440° and 490° C.

In the plating chamber 1, the deflector roll 51 changes the direction of travel of the strip S from horizontal to vertical, whereupon one side of the strip S comes in contact with the first coating roll 71 and the other side with the second coating roll 81. The rolls are positioned so that the strip S contacts each roll over a suitable arc of contact and is given a suitable tension. Raised or lowered by the screwdown mechanism 56 in the direction of arrow A, the deflector roll 51 is held in a suitable position. The first coating roll 71 is put in place by moving the movable section 3 of the plating chamber 1 back until the engaging end 47 contacts the C-shaped frame 41 preset in position by the operation of the hydraulic cylinder 42.

The deflector roll 51 is friction-driven by the running strip S. The coating rolls 71 and 81 are power-driven by the drive units so that the peripheral speed thereof because equal to, or falls within the range of 20 to 200 percent of, the travel speed of the strip S. The pickup rolls 73 and 83 are power-driven by the drive units at such peripheral speeds as are appropriate with reference to the peripheral speeds of the coating rolls 71 and 81 and depending on the coating weight. The deflector roll 51 also can be power-driven by a drive unit similar to those for the coating and doctor rolls.

The pickup roll 73 picks up the molten zinc M, which is then transferred onto the first coating roll 71. Therefore, a film of the molten zinc is formed on the peripheral surface of the first coating roll 71, then transferred onto one surface of the strip s coming in contact therewith to accomplish galvanizing thereof. For reducing the thickness of the zinc coating, the first coating roll 71 is driven faster than the pickup roll 73, or the clearance between said two rolls is reduced by actuating the hydraulic cylinder 117 to advance the movable bearing 76 (see FIG. 4). The coating thickness is increased by reversing the above procedures.

When extra-thin coatings are desired, the doctor rolls 328 and 329 can be brought in contact with the peripheral surface of the coating rolls. The doctor rolls may be either idle rolls, in which case they are friction-driven by the coating rolls and the clearance therebetween is adjusted by the same method as with the pickup rolls, or power-driven at varying speeds.

The weight of the coating can also be adjusted by changing the peripheral speed of the coating roll 71 with respect to the travel speed of the strip. Coating weight decreases as the peripheral speed of the coating roll 71 is slowed down with respect to the travel speed of the strip S. When the peripheral speed is increased, the coating weight increases up to a maximum, but gradually decreases thereafter.

Another method of reducing coating thickness is to blow a reducing or inert gas through the nozzle 330 onto the coated surface of the strip S. This method is used for further reducing the thickness of a thin coating that has been applied by the coating roll onto the strip surface. Therefore, this method can control coating weight with much less gas at a much lower pressure, compared with the conventional gas wiping method used for the hot-dipping process.

The other side of the strip S is similarly galvanized by the second coating roll 81 and the pickup roll 83.

The above-described operation is for galvanizing both sides of the strip S. When galvanizing only one side, the movable section 3 of the plating chamber 1 is shifted, by actuating the hydraulic cylinder 42, to the point where the first coating roll 71 is separated from the surface of the strip S. Then, only one side of the strip S is galvanized by the second coating roll 81. When neither side is galvanized, the screwdown mechanism 56 is actuated to obliquely lower the deflector roll 51, thereby separating the second coating roll 81 from the surface of the strip S. Then the strip S is supported by the deflector roll 51 inside the plating chamber 1 and the deflector roll 211 at the top of the apparatus.

Different thickness coatings can be provided on both sides of the strip S by changing the peripheral speeds of the coating and pickup rolls and the clearance therebetween as described before.

The coating metal used in the above-described embodiment is zinc. The method and apparatus according to this invention are also applicable to such other metals as lead, tin, aluminum, copper and alloys thereof.

Different coatings can be provided on the respective sides of the strip S by supplying different coating metals to the molten metal baths 141 and 145, for example, molten zinc to one bath and a molten alloy zinc and aluminum to the other.

Coating can be provided selectively on one or neither side of the strip S by cutting off the supply of molten metal M to the coating rolls 71 and 81 by separating the pickup rolls 73 and 83 from the coating rolls 71 and 81.

This invention is not limited to the above-described embodiment in which the coating roll is separated from the non-coated strip surface by shifting the movable section of the plating chamber and the deflector roll. There are several other practical ways to accomplish this as described hereunder. The plating chamber, pickup rolls, molten metal baths and molten metal supply pipes, which operate substantially the same as and produce the same results as the embodiment of FIG. 1, will be designated by similar reference numerals in FIGS. 6 through 12, a detailed description being omitted. Further, the deflector and pickup rolls drive units, doctor rolls, wiping nozzles, plating chamber sealing mechanisms and molten metal supply devices will be neither described nor illustrated in the following.

FIGS. 6 through 9 show embodiments in which the coating rolls are directly shifted away from the strip surface.

Figure 6:
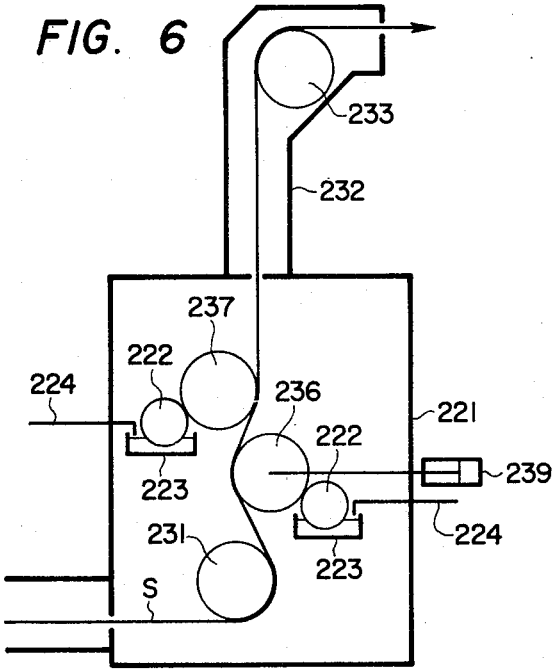
FIGS. 6 through 13 schematically illustrate the construction of other embodiments of the plating apparatus according to this invention.

In FIG. 6, a strip S is vertically supported by a deflector roll 231 in a plating chamber 221 and a deflector roll 233 in a passage 232, with coating rolls 236 and 237 disposed in vertically spaced positions on opposite sides of the strip S. Molten coating metal is supplied through supply pipes to molten metal baths 223, from which pickup rolls 222 supply a thin film of coating metal to coating rolls 236 and 237. Both sides of the strip S are being coated in FIG. 6. When coating one side only, the coating roll 236 is drawn away from the surface of the strip S by actuating a hydraulic cylinder 239.

Figure 7:
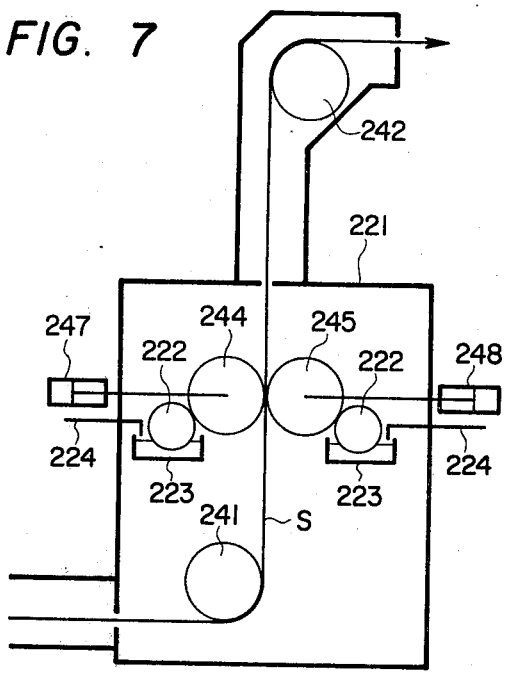

In the embodiment of FIG. 7, the strip S is vertically moved through a plating chamber 221 by deflector rolls 241 and 242. Coating rolls 244 and 245 are symmetrically disposed on opposite sides of the strip S. When coating both sides, both coating rolls 244 and 245 are brought in contact with the strip S. When coating one or neither side, the coating roll 244 and/or 245 is withdrawn by actuating a hydraulic cylinder 247 and/or 248.

Figure 8:
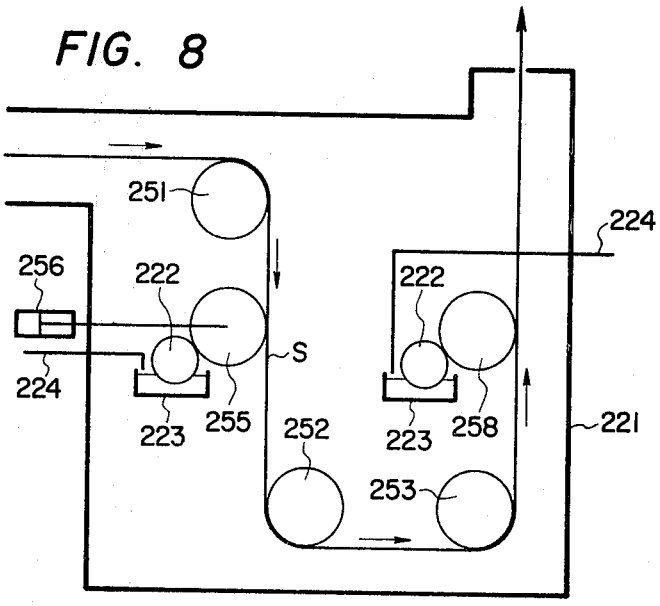

The embodiment shown in FIG. 8 has three deflector rolls 251, 252 and 253, a shiftable coating roll 255 on the entry side, and a fixed coating roll 258 on the exit side of a plating chamber 221. When coating one side only, the coating roll 255 is withdrawn by a hydraulic cylinder 256.

Figure 9:
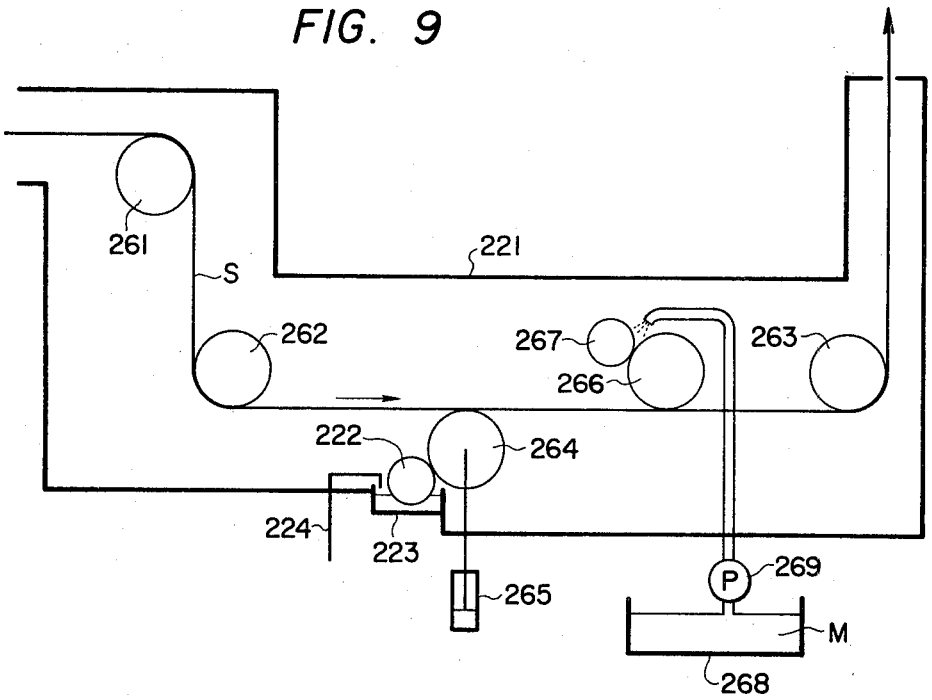

The embodiment of FIG. 9 has three deflector rolls 261, 262 and 263 in a plating chamber 221. Unlike the above-described embodiments, this apparatus provides coating on a strip S held in the horizontal position. For one-side coating, a first coating roll 264 is lowered by a hydraulic cylinder 265. Then, one side of the strip S is coated by a second coating roll 266 that is kept in contact with a doctor roll 267. A pump 269 pumps molten metal M from a molten metal bath 268 to between said two rolls. When neither side is coated, the first coating roll 264 is lowered, and the pump 269 is stopped to discontinue the supply of molten metal to the second coating roll 266.

Figure 10:
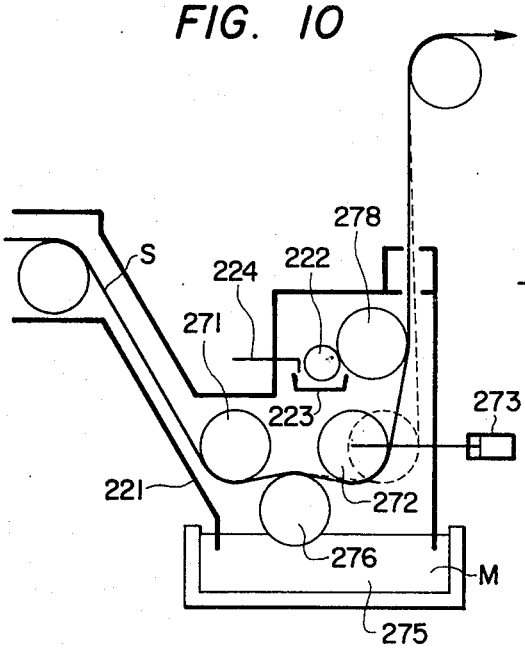
Figure 11:
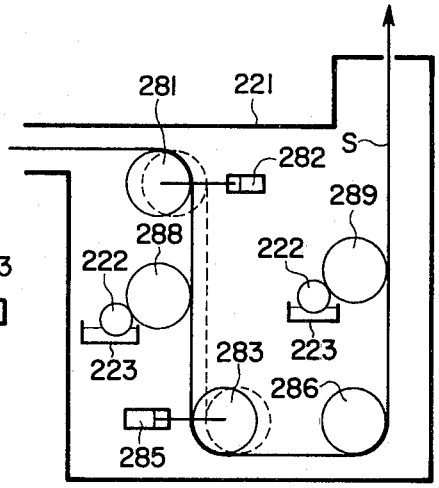
Figure 12:
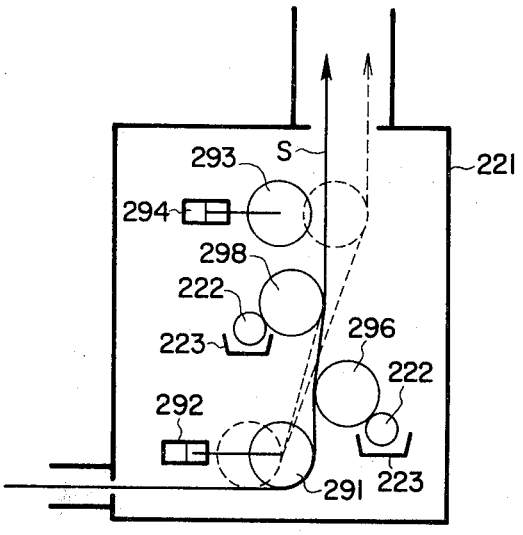

In the embodiments shown in FIGS. 10 through 12, the deflector rolls are shifted to separate the coating rolls from the strip surface.

The embodiment of FIG. 10 has two deflector rolls 271 and 272 in a plating chamber 221, with one deflector roll 272 being horizontally shiftable by a hydraulic cylinder 273. One side of the strip S is coated by a first coating roll 276 that picks up molten coating metal M direct from a molten metal bath 275. When coating one side only, the deflector roll 272 is shifted by a hydraulic cylinder 273 to the position indicated by dotted lines, thereby drawing the second coating roll 278 away from the surface of the strip S.

The embodiment of FIG. 11 has two deflector rolls 281 and 283, adapted to be horizontally shifted by hydraulic cylinders 282 and 283 respectively, and a fixed deflector roll 286 in a plating chamber 221. When coating both sides, coating rolls 288 and 289 are brought in contact with the strip S. When coating one side only, the deflector rolls 281 and 283 are shifted to positions indicated by dotted lines, thereby horizontally shifting the strip s away from the coating roll 288.

The embodiment of FIG. 12 has two deflector rolls 291 and 293, which are horizontally shifted by hydraulic cylinders 292 and 294, in a plating chamber 221. When coating both sides, the deflector rolls 291 and 293 are in positions indicated by solid lines, with coating rolls 296 and 298 contacting both sides of the strip S. For one-side coating, the lower deflector roll 291 is withdrawn to a position indicated by dotted lines. As seen, the strip S then contacts the upper coating roll 298 only. When coating neither side, the lower deflector roll 291 is withdrawn to the position indicated by dotted lines and the upper deflector roll 293 advanced to a position indicated by dotted lines. As indicated by the dotted lines, the strip S then is separated from the two coating rolls 296 and 298.

As mentioned previously, different coatings can be provided on both sides of the strip by supplying different molten coating metals to the two coating rolls. But when using two coating metals with widely different melting points in one plating chamber, the temperature of the plating chamber should be kept at or above the higher melting point. This results in an excessive growth of the alloy layer between the lower-melting-point coating metal and the steel base, which impairs the adhesiveness of the obtained coating. Especially when the coating metal is zinc, it evaporates, due to the elevated vapor pressure inside the plating chamber and on the surface of the strip, thereby contaminating the plating chamber and damaging the strip quality. This evaporation is disadvantageous from the stand-point of thermal economy, too. Preferably, in general, the plating chamber temperature should not exceed 300° C. above the melting point of the coating metal.

Figure 13:
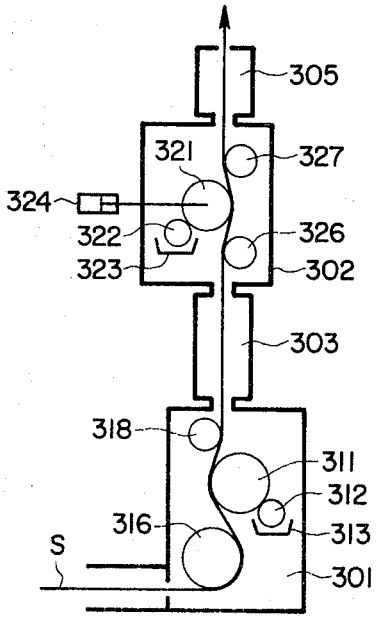

FIG. 13 shows an embodiment suited for coating metals with widely different melting points on both sides of a strip. This embodiment will be described by reference to an example of coating one side of a strip with aluminum and the other side with zinc the melting point of which is lower than aluminum.

The apparatus comprises a first plating chamber 301 and a second plating chamber 302 vertically disposed one above the other, with a temperature control chamber 303 therebetween. The first plating chamber 301 contains a first coating roll 311, pickup roll 312, and a molten aluminum bath 313. The second plating chamber 302 contains a second coating roll 321, a pickup roll 322, and a molen zinc bath 323. A steel strip S passes through the first plating chamber 301, then upwardly through the second plating chamber 302.

In the first plating chamber 301, which is kept at 680° C., the strip S is pressed against the first coating roll 311 by a deflector roll 316 and a backup roll 318, whereby one side thereof is coated with aluminum.

The aluminum-coated strip S is cooled in the temperature control chamber 303 to a temperature suited for zinc coating. This cooling inhibits excessive growth of the alloy layer, thereby preventing the lowering of the coating adhesiveness.

Entering the second plating chamber 302, which is kept at 450° C., the strip S is pressed against the second coating roll 321 by backup rolls 326 and 327, whereby the remaining side thereof is coated with zinc.

The strip S thus coated with the different metals is cooled in a cooling chamber 305, then delivered to a subsequent process.

The coating order may be reversed; zinc coating can precede aluminum coating. In this case, the galvanized strip S is heated in the temperature control chamber 303 to a temperature suited for aluminum coating. This heating turns the zinc layer into an Fe-Zn alloy layer. This alloying enhances paintability and weldability. But excessive alloying, impairing the adhesiveness of metal coating, should be avoided.

When used for cooling, the temperature control chamber 303 is similar to the cooling device 206 shown in FIG. 1. When used for heating, an electric heater is provided in the chamber.

When one-side coating is performed in the apparatus of FIG. 13, the second coating roll 321 is withdrawn from the strip S by a hydraulic cylinder 324.

What is claimed is:

1. A method of applying a coating of molton plating metal to a strip, comprising the steps of heating a metal strip to a temperature suited for plating with a molten plating metal, feeding the thus heated metal strip through a reducing or inert atmosphere heated to a temperature suited for molten metal plating, providing horizontally disposed power-driven coating rolls adjacent the path of the strip through said atmosphere and on opposite sides of the strip, continuously supplying a molten plating metal to the peripheral surface of each coating roll, and guiding the strip through the atmosphere by at least one horizontally disposed deflector roll, and when it is desired to coat both sides of said strip, moving said coating rolls and said strip relative to each other for bringing said coating rolls and strip in contact to transfer plating metal from the coating rolls to the opposite sides of said strip, and when it is desired to coat only one-side of said strip, moving said coating rolls and said strip relative to each other for bringing coating roll on the side of said strip which it is desired to coat into contact with said strip to transfer plating metal from the coating roll to the said side of the strip, and when it is desired to coat neither of said strip, moving said coating rolls and said strip relative to each other for keeping said coating rolls and said strip out of contact.

2. The method as claimed in claim 1 in which said coating rolls are moved relative to said strip for moving said strip and said rolls into and out of contact.

3. The method as claimed in claim 1 in which said deflector roll is moved for moving said strip into and out of contact with at least one of said coating rolls.

4. The method as claimed in claim 1 in which at least one of said coating rolls and said deflector roll are moved for moving said strip into and out of contact with said coating rolls.

5. The method as claimed in claim 1 in which the atmosphere in the vicinity of one of said coating rolls is heated to a temperature for plating one type of plating metal and said one type of plating metal is supplied to said one coating roll, and the atmosphere in the vicinity of the other coating roll is heated to a temperature for plating a different type of plating metal, and said different type of plating metal is supplied to said other coating roll.

6. A method of applying a coating of molten plating metal to a strip, comprising the steps of heating a metal strip to a temperature suited for plating with a molten plating metal, feeding the thus heated metal strip through a reducing or inert atmosphere heated to a temperature suited for molten metal plating, providing horizontally disposed power-driven coating rolls adjacent the path of the strip through said atmosphere and contacting opposite sides of the strip, providing power driven pick-up rolls for each coating roll for supplying a molten plating metal from reservoirs for the respective rolls to the peripheral surface of each coating roll when the pick-up rolls contact the respective coating rolls and when it is desired to coat both-sides of said strip, moving both said pick-up rolls into contact with the corresponding coating rolls to supply plating metal to both coating rolls for application to the opposite sides of said strip, and when it is desired to coat only one-side of said strip, moving only one of said pick-up rolls into contact with said coating roll on the side of said strip which it is desired to coat to supply plating metal to the coating roll for application to the said side of the strip, and when it is desired to coat neither side of said strip, moving both pick-up rolls out of contact with the corresponding coating rolls.

* * * * *